US006564395B2

(12) United States Patent
Keen

(10) Patent No.: US 6,564,395 B2
(45) Date of Patent: May 20, 2003

(54) WRESTLER HEADGEAR

(76) Inventor: James C Keen, 7890 Base Lake, Dexter, MI (US) 48130

( * ) Notice: Subject to any disclaimer, the term of this patent is extended or adjusted under 35 U.S.C. 154(b) by 0 days.

(21) Appl. No.: 09/863,026

(22) Filed: May 21, 2001

(65) Prior Publication Data

US 2002/0002733 A1 Jan. 10, 2002

Related U.S. Application Data

(63) Continuation of application No. 09/482,797, filed on Jan. 13, 2000, now abandoned.
(60) Provisional application No. 60/115,888, filed on Jan. 14, 1999.

(51) Int. Cl.[7] ..... A63B 71/10
(52) U.S. Cl. ..... 2/425
(58) Field of Search ..... 2/425, 209, 423, 2/417, 418, 419, 420

(56) References Cited

U.S. PATENT DOCUMENTS 2,898,596 A * 8/1959 Keen
3,513,482 A * 5/1970 Holden
4,710,985 A * 12/1987 Dubner et al.
4,821,345 A * 4/1989 Marchello
5,685,021 A * 11/1997 Tsujino
5,881,393 A * 3/1999 Marchello

* cited by examiner

*Primary Examiner*—Rodney M. Lindsey
(74) *Attorney, Agent, or Firm*—James M. Deimen

(57) ABSTRACT

Protective wrestler headgear having straps fully adjustable by the user with the headgear in place on the head. To allow adjustment of each strap, the adjustment is spaced from the ear cover an amount sufficient to permit some small spacing from the head thereby providing sufficient room for the strap to be moved through the adjustment element that is attached to the ear cover. In the embodiment described below, the adjustment element comprises a "D-ring" attached to, but spaced from, the ear cover. The strap extending from the other ear cover passes through the D-ring with enough clearance from the head and nearest ear cover to permit movement of the strap relative to the D-ring with the headgear in place on the wrestler's head.

4 Claims, 2 Drawing Sheets

WRESTLER HEADGEAR

This application claim is a continuation of application Ser. No. 09/482,797, filed Jan. 13, 2000, now abandoned, and provisional patent application No. 60/115,888, filed Jan. 14, 1999.

This application is based on provisional patent application No. 60/115,888 filed Jan. 14, 1999.

BACKGROUND OF THE INVENTION

The field of the invention pertains to the sport of wrestling and, in particular, to protective headgear worn by participants. The protective headgear is primarily directed to prevention of damage to the ear pinnae. The first such headgear specifically for the protection of wrestlers'ears was disclosed in U.S. Pat. No. 2,898,596 and is very successfully used in collegiate wrestling.

In subsequent years, a variety of protective headgear has been patented, all sharing in common with the above patent relatively rigid ear coverings held in place by a plurality of straps. The straps are adjustable and generally pass over the head, behind the head and over or under the chin.

U.S. Pat. No. 3,596,288 discloses straps that are integral with the ear coverings as distinguished from the previous patent above which utilizes slots for the straps, the slots being formed in the ear coverings.

U.S. Pat. No. 4,551,861 discloses a construction of the ear covering simplified for more economical manufacture by making the ear pad from a single sheet of soft resilient plastic.

U.S. Pat. No. 4,821,345 discloses a multiple layer ear cover having a metal reinforcing plate as one of the interior layers and to which the straps are attached. Various features are disclosed to reduce the tendency of the molded plastic parts of the ear cover to tear.

U.S. Pat. No. 5,504,945 discloses an ear cover having a molded flexible outer cover with a plurality of apertures and a foam pad beneath the outer cover that protrudes through the apertures. The protruding foam is provided for added protection to both the user and his opponent.

U.S. Pat. No. 5,685,021 discloses an ear cover having a gel cushioning layer and a tacky exterior surface to grip the area surrounding the wrestler's ear. In using all of the above wrestling headgear, the headgear must be removed from the head to adjust the straps. Proper adjustment is therefore time consuming and tedious. The adjustment elements in the above patents are made a part of the ear cover and when tight to the head cannot be easily loosened or tightened.

SUMMARY OF THE INVENTION

The invention comprises straps fully adjustable by the user with the headgear in place on the head. To allow adjustment of each strap, the adjustment is spaced from the ear cover an amount sufficient to permit some small spacing from the head thereby providing sufficient room for the strap to be moved through the adjustment element that is attached to the ear cover. In the embodiment described below, the adjustment element comprises a "D-ring" attached to but spaced from the ear cover. The strap extending from the other ear cover passes through the D-ring with enough clearance from the head and nearest ear cover to permit movement of the strap relative to the D-ring with the headgear in place on the wrestler's head.

DESCRIPTION OF THE PREFERRED EMBODIMENT

Figure 1:
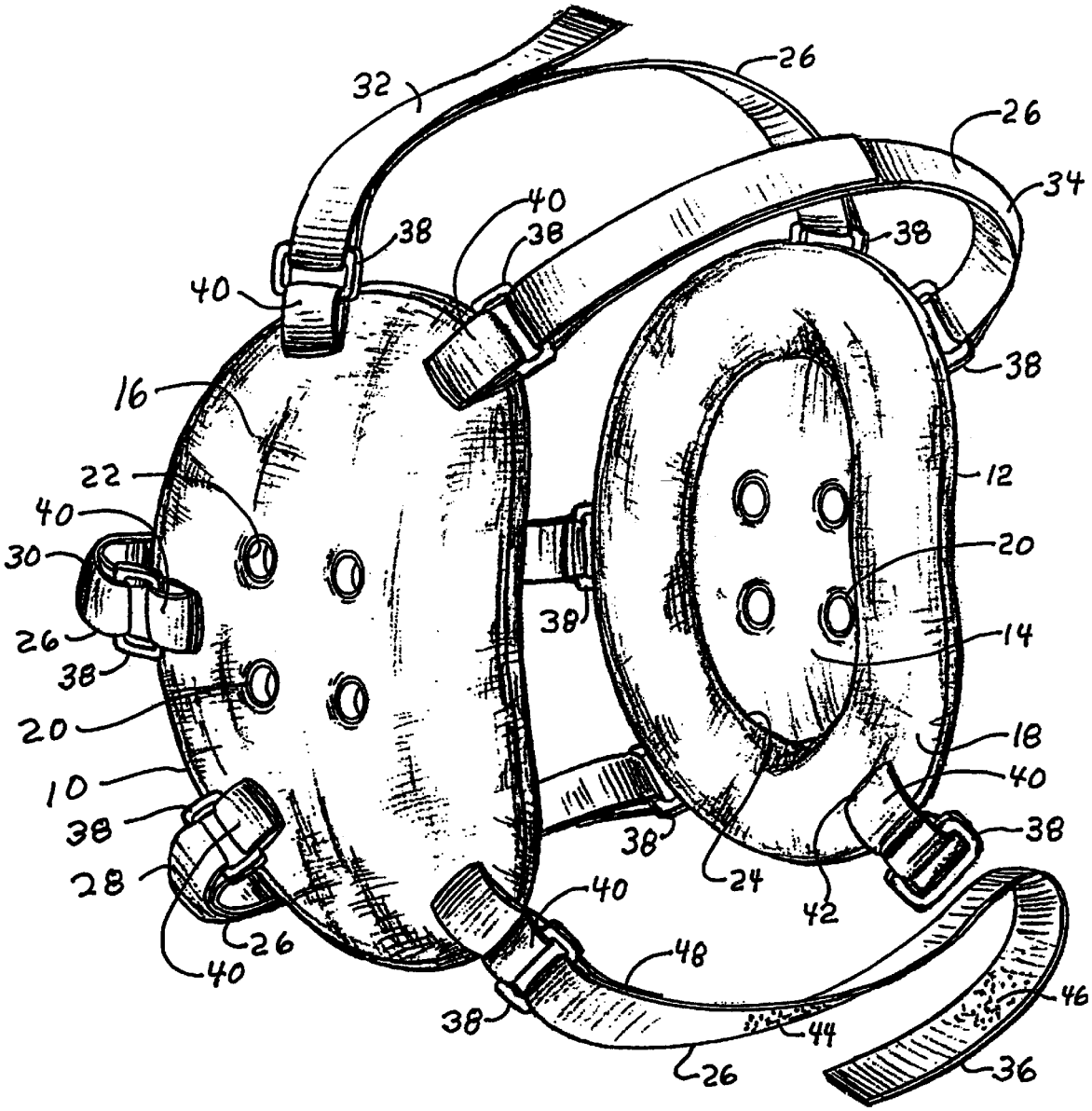
FIG. 1 is a face forward perspective view of the improved headgear.
Figure 2:
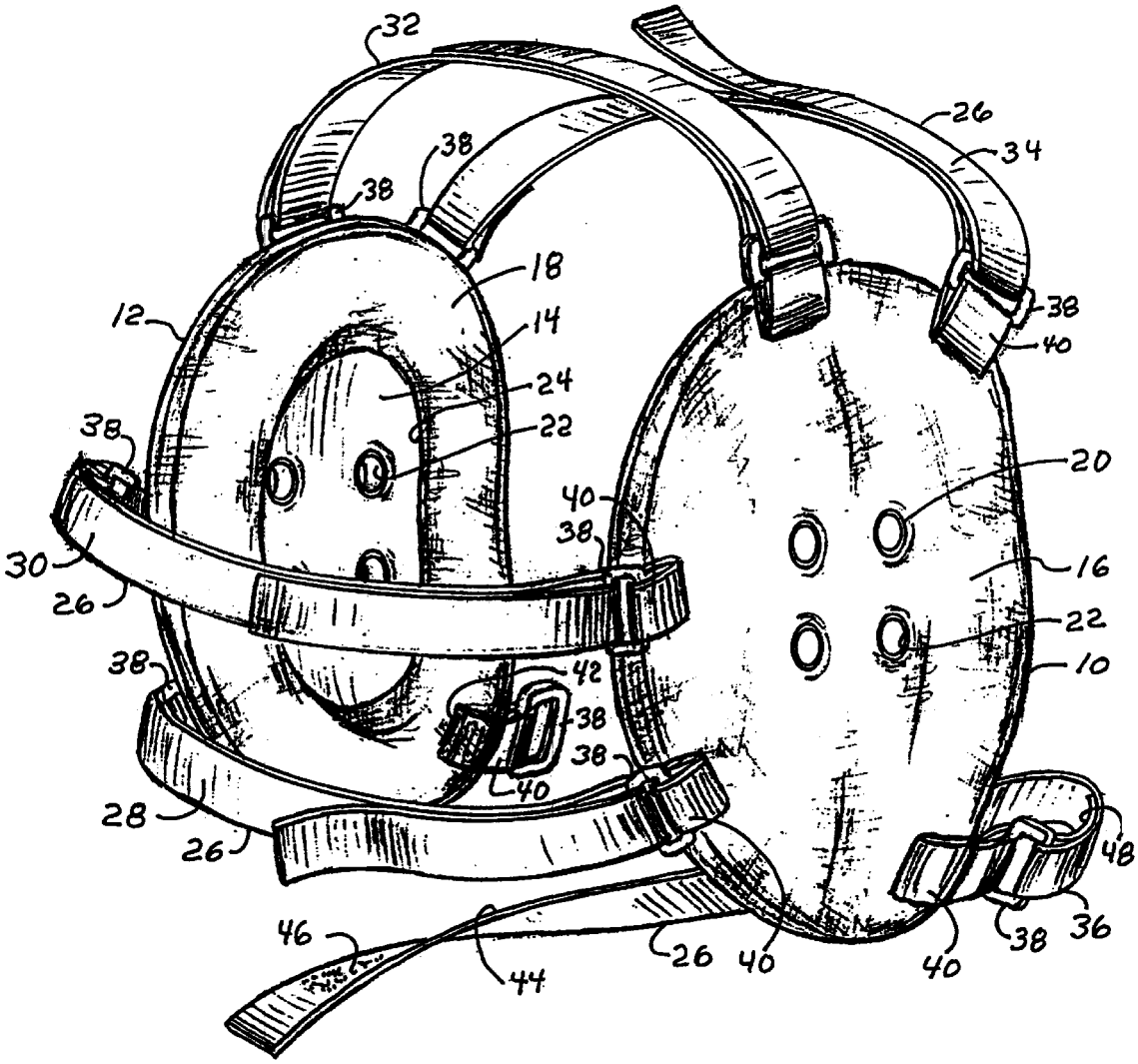
FIG. 2 is a face away perspective view of the improved headgear.

As shown in FIGS. 1 and 2, the new headgear comprises a pair of right 10 and left 12 ear covers. The ear covers 10 and 12 are each constructed with two rigid plastic ear protectors, the innermost being shown at 14 for the left ear cover 12. The entire exterior outside 16 of each ear cover 10 or 12 is covered with a cloth covered neoprene or similar foam padding, this padding being extended over the periphery of the ear cover 10 or 12 to form the head contacting padding 18 about the ear. A plurality of hollow rivets 20 penetrate and retain the two rigid plastic ear protectors and the exterior outside 16 cloth covered padding together. The through holes 22 in the rivets provide air vents to the wrestler's ears, and the contacting padding 18 is tucked under the peripheral edge 24 of the innermost rigid ear protector 14.

Five adjustable strap assemblies 26 of substantially the same components join the ear covers 10 and 12 together. Lower 28 and mid 30 back straps are at the back of the wrestler's head. A top strap 32 passes over the top of the wrestler's head and a forehead strap 34 passes over the wrestler's forehead. Completing the strap assemblies 26 is a chin strap 36.

Each ear cover 10 or 12 is constructed with five D-rings 38 each flexibly retained to the ear cover with short pieces of strap material 40 that pass through holes in the exterior outside 16 and through holes formed in the rigid plastic ear protectors covered by the cloth and foam padding. In this particular embodiment, the short pieces of strap 40 that retain the D-rings 38 for the chin strap 36 also pass through holes in the head contacting padding 18 as shown at 42 in each figure.

Each strap 28, 30, 32, 34 and 36 is constructed with complementary hook and loop fasteners such as shown at 44 and 46 on the chin strap 36. The chin strap 36 is permanently overlap sewn at 48 to the corresponding D-ring 38 on the right-ear cover 10. The other four straps 28, 30, 32 and 34 are similarly sewn to the corresponding D-rings 38 on the left ear cover 12.

I claim:

1. Wrestler headgear comprising right and left ear covers, said ear covers each comprising an innermost rigid member and an exterior cover padding, said cover padding extending over the periphery of the ear cover to form head contacting padding, a plurality of strap assemblies adapted to connect the right and left ear covers together about the skull of a wrestler, said strap assemblies including a plurality of D-rings spaced from and flexibly attached by straps to at least one of the ear covers, each D-ring being adapted for passage there through of at least one adjustable strap and at least one of said D-rings being spaced by at least one of said flexible straps of a length sufficient to permit movement of the D-ring away from a wrestler's head an amount sufficient to permit adjustment of the corresponding strap assembly without removal of the headgear from the wrestler's head.

2. The wrestler headgear of claim 1, including said head contacting padding being tucked under the peripheral edge of the innermost rigid ear protector.

3. The wrestler headgear of claim 2, including a plurality of hollow rivets in each ear cover extending through and retaining together the innermost rigid ear protector and the exterior cover padding, said hollow rivets thereby providing vent holes through each ear cover.

4. Wrestler headgear comprising an innermost rigid ear protector having a peripheral edge and an exterior cover padding, said cover padding extending over the periphery of an ear cover to form a head contacting padding, a plurality of hollow rivets in each ear cover extending through and retaining together the innermost rigid ear protector and the exterior cover padding, said hollow rivets thereby providing vent holes through each ear cover, and said head contacting padding being tucked under the peripheral edge of the innermost rigid ear protector.

* * * * *